US005388539A

United States Patent [19]

Guerreschi

[11] Patent Number: 5,388,539

[45] Date of Patent: Feb. 14, 1995

[54] CLAMP DEVICE OR JIG-GUIDE AND DEVICE FOR PRE-POSITIONING AND SHIFTING CLOTH TO BE COUPLED WITH A PROGRAMMABLE SEWING MACHINE.

[75] Inventor: Carlo Guerreschi, Cadidavid, Italy

[73] Assignee: VI.BE.MAC.S.r.l., Verona, Italy

[21] Appl. No.: 48,752

[22] Filed: Apr. 16, 1993

[30] Foreign Application Priority Data

Apr. 28, 1992 [IT] Italy ..... VR92A000039
Oct. 29, 1992 [IT] Italy ..... VR92U000060

[51] Int. Cl.[6] ..... D05B 21/00
[52] U.S. Cl. ..... 112/121.12; 112/121.15
[58] Field of Search ..... 112/121.12, 121.15, 112/262.3, 265.1, 104, 113, 114

[56] References Cited

U.S. PATENT DOCUMENTS 4,493,276 1/1985 Sadeh ..... 112/121.12
4,719,863 1/1988 Bisson ..... 112/121.12
4,813,362 3/1989 Vogt et al. ..... 112/121.12
4,996,931 3/1991 Mall ..... 112/121.12
5,012,752 5/1991 Murata ..... 112/121.12
5,014,633 5/1991 Murata et al. ..... 112/121.12

*Primary Examiner*—Peter Nerbun
*Attorney, Agent, or Firm*—Notaro & Michalos

[57] ABSTRACT

Equipment that positions and clamps a piece of cloth or the like on a base fabric through a jig-guide (13) (17), moves automatically when a first seam has been sewn on the most external edge. In this way it is possible to sew further seams in the inner part of the first seam according to any preset pattern. The said jig-guide is coupled to a further device the purpose of which is the facilitation of the loading and positioning operations during which the pieces of cloth are to be loaded and positioned. Such operations are carried out very easily and quickly through a load sliding plane (31) which is provided only with precise references and does not have any further mechanism which might hinder the insertion of the cloth. The sliding plane (31) moves on a fixed bed (32) since the edges of the first plane are bent downwards on the edges of the second plate and the first plane slides on the second plate through the a piston or the like (42).

12 Claims, 5 Drawing Sheets

7
2
3
4
6
10
19
8
18
19
9
10
26
26
15
5
15
28
28
27
27
2
30
30
29
29
24
20
11
20
11
16
21
14
12
12
22
23
13
1
25
17

7
3
2
4
6
10
9
10
8
5
15
15
11
2
14
11
13

CLAMP DEVICE OR JIG-GUIDE AND DEVICE FOR PRE-POSITIONING AND SHIFTING CLOTH TO BE COUPLED WITH A PROGRAMMABLE SEWING MACHINE.

FIELD AND BACKGROUND OF THE INVENTION

The present invention relates to a device consisting of a movable jig-guide to be coupled with a programmable sewing machine or similar machines for positioning, clamping and automatically sewing pieces of cloth such as pockets or other parts on a base fabric, and a device for prepositioning and automatically shifting the said pieces of cloth toward the jig-guide itself.

Some types of sewing machines are at present known for the several assembling functions needed for assembling articles of clothing, the realization of such sewing machines being different according to their respective functions.

One of the most frequent problems of the said sewing machines is the difficulty in positioning the pieces of cloth such as patch pockets on a base fabric rapidly and precisely since it is difficult to position a piece of cloth in the exact point of application and to keep it clamped during the sewing operation, in particular during the sewing of the most external edge which is necessary in the cited example.

To this end blocking means are used for clamping the cloth to be sewn. However such means are often inadequate, above all owing to the lack of precision and difficulty in the usage. In general these means consist of a shaped plane which has a concave surface, concave in relation to the edge, since it is necessary to sew both the most external edge and a more internal seam, parallel or not to the external edge.

In these cases, the holding space of the shaped plate is too limited, there being the possibility of a lifting of the cloth and consequent difficulties in sewing. Therefore the finished articles of clothing often show defects which make them unwearable. As a consequence of this, there is an excessive waste of material and labor which weighs heavily on the cost of the finished good.

SUMMARY OF THE INVENTION

In order to eliminate the aforesaid inconveniences and other consequent ones, a device has been conceived and carried out according to the present invention for positioning a part of the base fabric on a movable bearing plate and then lowering a particular jig-guide on the movable plate, such jig-guide determining the exact position of the component which has to be applied to the base fabric itself, and above all permitting the component remain clamped in all its surface by means of a particular form during a first phase of the sewing process.

In particular the present device permits form clamped piece of cloth to be sewn on the base fabric is moved backwards automatically when the first seam on the most external edge has been sewn. Then, it is possible to sew other seams in the inner part of the first seam according to any preset pattern.

The device in question reduces the action of the user just to a simple positioning of the base fabric on the references of the movable plate and to a subsequent laying of the cloth in the inner part of the jig-guide. Then, the sewing machine carries out all the operations automatically and precisely for sewing and guiding the cloth itself, without the necessity of controlling and guiding the operation manually, as in known solutions.

Another object of the present invention consists in supplying a tool which is fit to be coupled with the jig-guide and permits an easier preloading of the cloth on a suitable movable plane which conveys the cloth itself, automatically to the jig-guide itself.

An immediate advantage of such a preloading device derives from the fact that the piece of cloth to be sewn positioned very rapidly and easily on a plane which is provided only with precise references and therefore, this plane does not show any mechanism which may hinder the loading operation.

Furthermore, the preloading operation is carried out when the sewing machine automatically performs the sewing phase for sewing the cloth which has been previously inserted and therefore there are time intervals between a loading operation and the subsequent loading operation during which the operator may carry out other operations such as a control of the machine or the preparation of the cloth or other task.

According to the present invention, all the aforesaid features and objects are reached with jig-guide which is meant to be coupled with a programmable sewing machine or the like, for positioning and sewing pieces of cloth or the like automatically on a base fabric, and with a device for prepositioning and shifting cloth to the jig-guide.

The said jig-guide is mainly characterized by comprising a supporting plane which slides on cross-rails and supports a plate on which the fabric is put and a sliding socket which slides longitudinally on the plane itself and supports both parallel lateral swinging arms for holding a reference jig and means for supporting and shifting a clamping form which swings and acts in the inner part of the jig. The clamping form, which blocks the piece of cloth to be sewn, is retracted after a first sewing operation through the intervention of a piston which permits the form support to slide on horizontal, rods. The said supporting socket moves in two directions, orthogonal to each other, through a transversal shifting of the plane which holds the supporting socket itself, such displacement being actuated by a stepping motor or the like, and further, the supporting socket moves longitudinally on the plane itself through the intervention of a rod which is moved from the inner part of the sewing machine by an electric motor. Both jig supporting arms and the clamping form may being lowered or raised in relation to the supporting plane by means of pistons which are arranged two by two symmetrically. The electronic combination and synchronisation of the transversal and longitudinal movements that are carried out by the jig-guide and jig supporting plane along with the retracting movement of the form, offer the possibility of sewing in a totally automatic way, a first peripherical seam on the edge of the piece of cloth which is completely clamped by the form as well as one or more seams in the inner part of the first seam after a backward translation of the form itself. Such operations are actuated and controlled by a central electronic unit which is connected to a data processor, such data being selected through a push-button strip or the like. The prepositioning and translating device, which prepositions the cloth and shifts the same to the jig-guide, consists of a slidable horizontal plane which may be positioned over the sewing bed of the sewing machine so as to be moved and placed over the sewing bed itself. The said slidable horizontal plane is provided with suitable references which may be luminous references or other references, and permit a precise positioning of the cloth itself. The said slidable plane is moved by a pneumatic jack or the like on slide-ways. The displacement according to a predetermined measure of the slidable plane, which conveys the prepositioned cloth to the jig-guide, permits the cloth itself to be conveyed to the jig-guide and held by the jig-guide itself for the different sewing phases.

BRIEF DESCRIPTION OF THE DRAWINGS

The invention will be better understood from the following description of a preferred solution of the present invention, set forth as an example, not limiting the invention itself, based on the accompanying drawings in which.

DESCRIPTION OF THE PREFERRED EMBODIMENT

Figure 1:
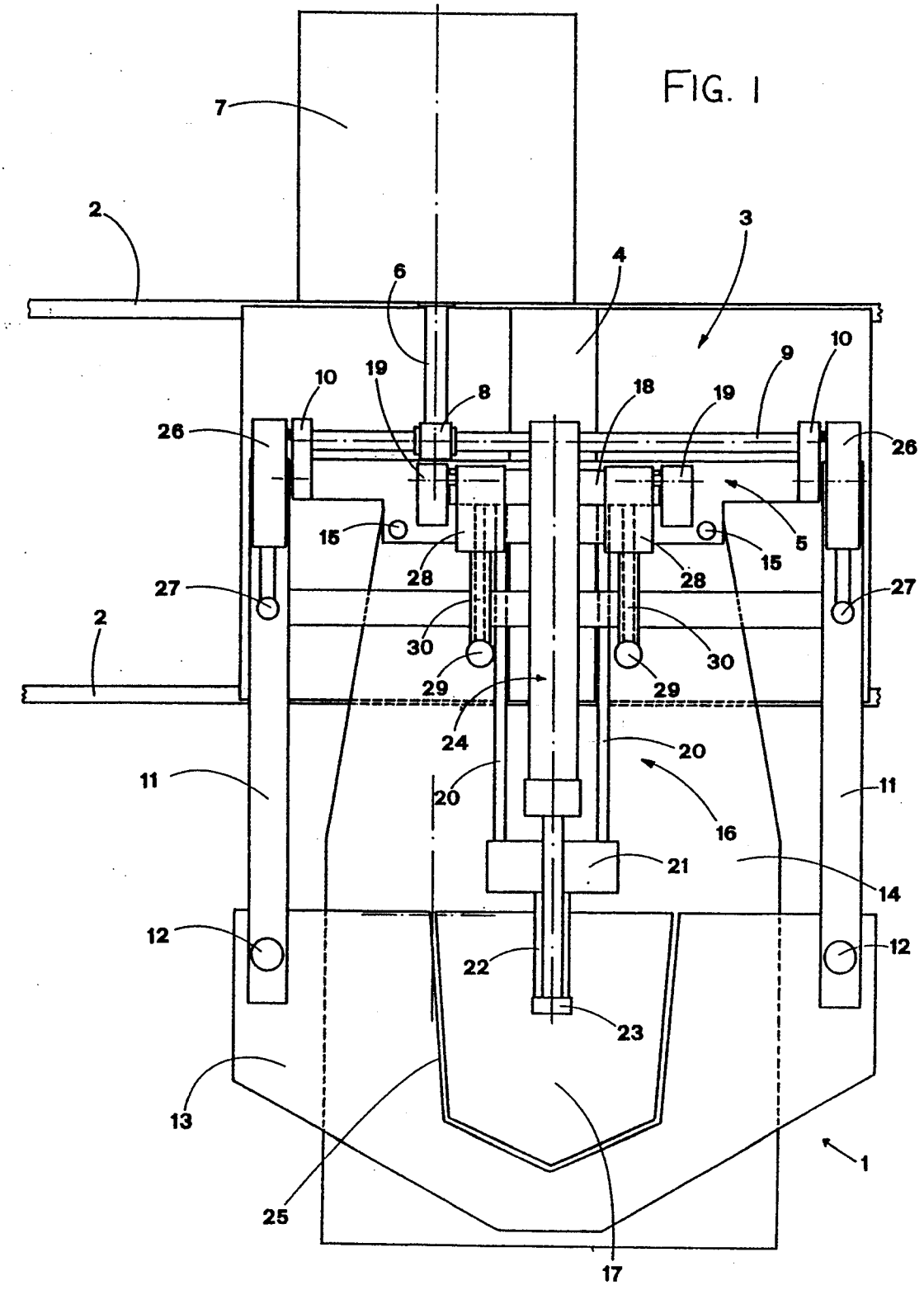
FIG. 1 shows a schematic plan view of the whole device according to the present invention.
Figure 2:
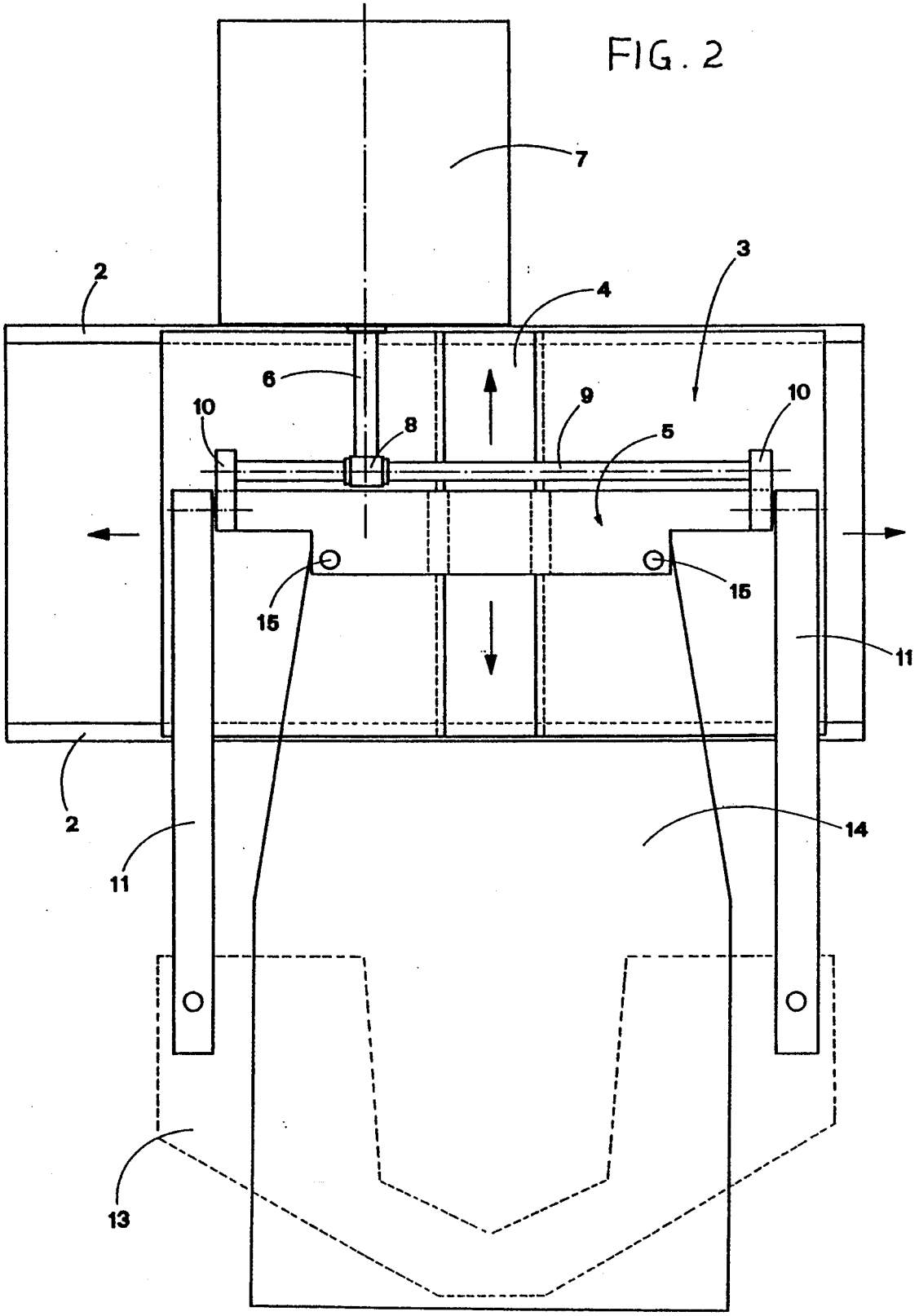
FIG. 2 shows a detail of the elements of transversal displacement of the movable supporting plane and the conveying assembly for the longitudinal movement of the jig-guide.
Figure 3:
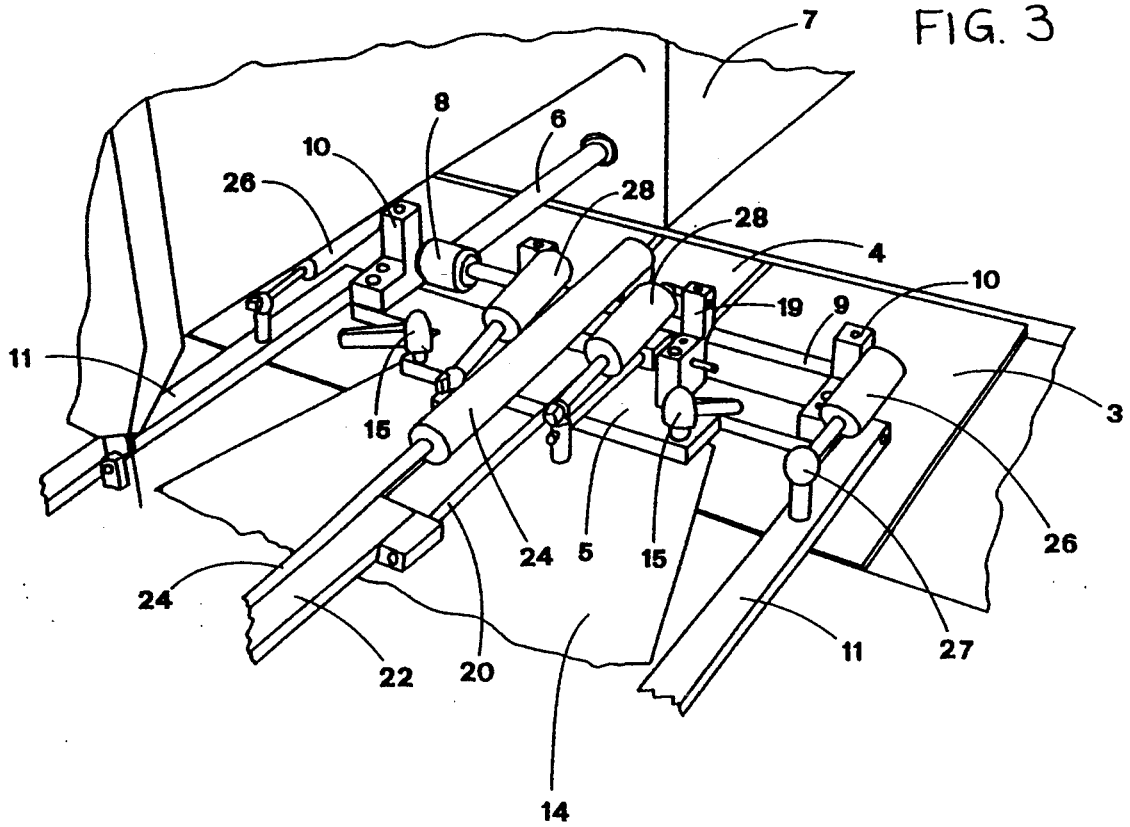
FIG. 3 shows a side schematic view of the lifting and lowering of frame and blocking and for the sliding of the clamping form itself.

With reference to the accompanying drawings, number 1 indicates, in general, a clamp device or jig-guide made to sew pieces of cloth on a base fabric which jig-guide is mounted on a working plane of a programmable sewing machine or other similar sewing machine, such sewing machines being preferably industrial sewing machines.

The device or jig-guide 1 comprises a pair of transverse rails 2 on which a sliding supporting plane 3 is mounted and has a central guide 4 which permits a horizontal socket 5 to be moved longitudinally and retained.

The displacements of the plane 3 and the socket 5, such displacements being or orthogonal to each other, are caused respectively by a stepping motor (not shown), which is arranged under the plane itself and causes the movement of the plane on the rails 2 through belts and gears, and by a rod 6 which extends from a machine casing 7 and is moved by a motor which is placed within the machine casing itself. An end of the rod 6 comprises a head 8 which is shaped in such a way that a horizontal shaft 9 may slide in a seat thereof. The shaft 9 slides orthogonally in relation to the rod 6 and is fixed to the socket 5 through shoulders 10. In this way the socket 5 is free to transversely move on the rails 2 together with the plane 3 and to longitudinally move along the guide 4, through the thrust action of the rod 6 on the shaft 9.

The combination and synchronization of the movements imparted by the rod 6 and by the stepping motor for the displacement of the plane 3 permit the socket 5 and all the devices supported by the socket itself and described below to be moved according to countless directions on the plane, both in a rectilinear sense and in a curvilinear sense, or in diagonal directions of different angles.

Besides holding the ends of the shaft 9, the shoulders 10 are provided with pivots for supporting two arms 11 which are arranged parallel to each other. A jig 13 is fixed on the free ends of the arms 11 by means of screws 12. The jig 13 holds the base fabric to which a piece of cloth is to be applied. Then, the piece of cloth is sewn in the inner part of a corresponding concave profile with which the jig 13 is provided.

The base fabric is positioned on a supporting plate 14 which is fixed on the socket 5 by means of screws 15. References are drawn on the supporting plate for permitting an exact positioning of the fabric itself.

A peculiarity of the present invention is to comprise, besides the aforecited components, a central assembly indicated general with the numeral 16. This assembly is mounted on the same socket 5 and acts within both arms 11 and the jig 13. The central assembly comprises a form 17 which may move onwards and backwards and is fit to hold the piece of cloth to be sewn on the base fabric since the form 17 is hollowed out in the internal profile of the jig 13 itself. The form 17 is connected to the socket 5 through an extending and lifting device which is mounted on a horizontal bar 18 which is pivoted on two brackets 19 which are fixed to the socket 5 itself. The horizontal bar 18 is provided with a pair of rods 20 which form the sliding elements for a support 21 which is fixed to an arm 22 on an end 23 of which the form 17 is fixed.

The support 21 and the relative form 17 may slide along rods 20 onwards and backwards through the action of a piston 24 which acts between the fastening 23 and the pivoted horizontal bar 18.

The form 17 is used for keeping the piece of cloth pressed throughout the surface thereof except the narrow peripheral edge on which the first seam is to be sewn. Moreover, the form 17 has a particular profile which must be slightly narrower than the internal profile of the jig 13 in order to insert in the jig itself and to leave a slot 25 between both pairs. The needle passes through the slot 25 during the first phase of the sewing of the most external edge of the piece of cloth to be sewn.

The function of the piston 24 is to extend the form 17 the internal profile of the jig 13 in order to effect the first seam and to retract the form 17 backwards to a certain extent in order to permit the needle to sew a second seam in the inner part of the first seam, according to a preset pattern.

In the example shown, the form 17 and the jig 13 are so shaped to permit the application of a patch pocket for instance to jeans trousers or the like, or the application of labels or ornaments of any kind which are sewn in relief or as a patch.

Both the jig 13 with the respective supporting arms 11 and the form 17 with the bar 18 and the rods 20 may be raised or lowered in order to permit the introduction, the keeping and the working of the material to be sewn.

To this end, the arms 11 are moved by the action of pistons 26 which are arranged on the shoulders 10 and act on pivots 27 which are fixed to the arms while the bar 18, which supports the form 17, is subjected to an angular displacement through further pistons 28 which are arranged between the brackets 19 and the pivots 29, the latter being fixed on the ends of arms 30 which are fixed on the bar 18 itself.

The pairs of pistons 26 and 28 execute a lifting and lowering action like a book for lifting and lowering the parts on which they are mounted since such pistons push, upwards or downwards, the coupling elements which are mounted on the arms of the parts, like a sort of lever.

Now we shall describe an example of functioning of the device according to the present invention.

For introducing the material in the supporting plate 14, both the jig 13 and the form 17 must be lifted so that the pistons 28 and 26 execute a backward movement after which both parts shift upwards.

At this stage the part of the fabric on which the piece of cloth will be sewn is inserted in the plate 14 through a loading device which shall be described below. The insertion is facilitated by reference lines or luminous indicators which have been previously applied to the plate itself.

Then, the jig 13 is lowered by the thrust of the pistons 26. Now it is possible to apply the pocket or other piece of cloth to be sewn on the base fabric in the inner profile of the jig 13. As a consequence of this, the form 17 is lowered to the jig 13 through the pushing action of the pistons 28.

After introducing and blocking the material in the retaining assembly, it is possible to actuate the first sewing phase which involves the movement of the whole assembly on the plane through synchronized movements which are imparted by the rod 6 for permitting a longitudinal sliding of the socket 5 and by the stepping motor for permitting a transverse displacement of the plane 3. The combination of such movements permits the slot 25 to be shifted in respect of the whole length thereof to the sewing needle on executing a first passage along the most external edge of the piece of cloth to be sewn.

When the whole line included in the slot 25 has been sewn along the most external edge of the pocket, the needle is positioned on the end opposite to the inlet point of the slot itself. At this stage, the form 17 is retracted by moving the rod of the piston 24 backward. Now there is the returning phase of the material supporting assembly. During this phase the needle may work a more internal sewing line than the preceding one, according to the preset drawing or pattern, on completing the sewing of the pocket or the like.

When the sewing process is finished, the material is set free by lifting the jig 13 and form 17. The jig 13 is lifted by retracting the piston 26 whereas the form 17 is lifted by retracting the piston 28. Now, the device is ready to receive further material to be sewn.

As an advantage the jig 13 and consequently also the form 17 may be interchanged very quickly with elements having different profiles. It is sufficient to act on the screws 12 and 15. Thus, it is possible to use the device for the most varied applications and forms of the pieces of cloth to be sewn, their complete clamping being always assured for permitting the first seam to be done correctly.

All the movements of the electric motors controlling the displacements on the material supporting assembly as well as the piston movements for positioning the material supporting means and the piston movement for permitting the form to slide are actuated and controlled by an central electronic unit which is connected to a data processor, such data being selected through a push-button strip or the like.

According to the present invention, a loading device shown in the FIGS. 4, 5, 6 and 7 is coupled with the jig-guide described. The loading device permits the base fabric to be prepositioned and automatically transported to the sewing elements, that is to the jig-guide itself.

In general the loading device consists of a movable supporting horizontal plane 31 which is mounted on a fixed fore plane 32 of a sewing machine 33 comprising the jig-guide 34 as previously described.

An L-shaped bracket 36 is fixed to a side of the base 35 of the sewing machine. Fixed sockets 38 are arranged on the outer side 37 of the bracket 36. The fixed sockets 38 support small shafts 39 which are fixed and are arranged horizontally and parallel to each other.

A movable socket 40 is mounted on the small shafts 39. The most external part of the plane 31 is fixed to the upper surface 41 of the movable socket 40 so that the whole assembly may be moved through the action of a piston 42 the rod 43 of which acts on the movable socket itself.

The sliding plane 31 may move on the fixed plane 82 since in the present example, the parallel borders of the first plane 31 are bent downwards so as to intersect the second one and therefore the plane 31 may slide on the plane 32.

The fixed part of the piston 42, which is preferably a pneumatic piston, is applied on the lower part to the fixed plane 32. The end of the fixed part, from which end the rod 43 extends, is connected to one of the sockets 38, and precisely the most internal one.

For holding the material, the movable supporting plane 32 is provided with a small arm 44 which is pivoted upon a socket 45 which is adjustable along a guide A channel 47 is provided along the fore edge of the movable plane. The channel 47 is connected to the pneumatic circuit of the piston 42 and is provided with a series of suction borings which prevent the material from slipping backwards.

Finally, the movable plane 31 itself may be provided with fixed references, not shown, for the positioning of the material. Moreover, the positioning may be also facilitated by means of aim projectors 48 which are mounted on an end of an arm 49. The other end of the arm 49 is fixed to the part 37 of the bracket 36.

Figure 4:
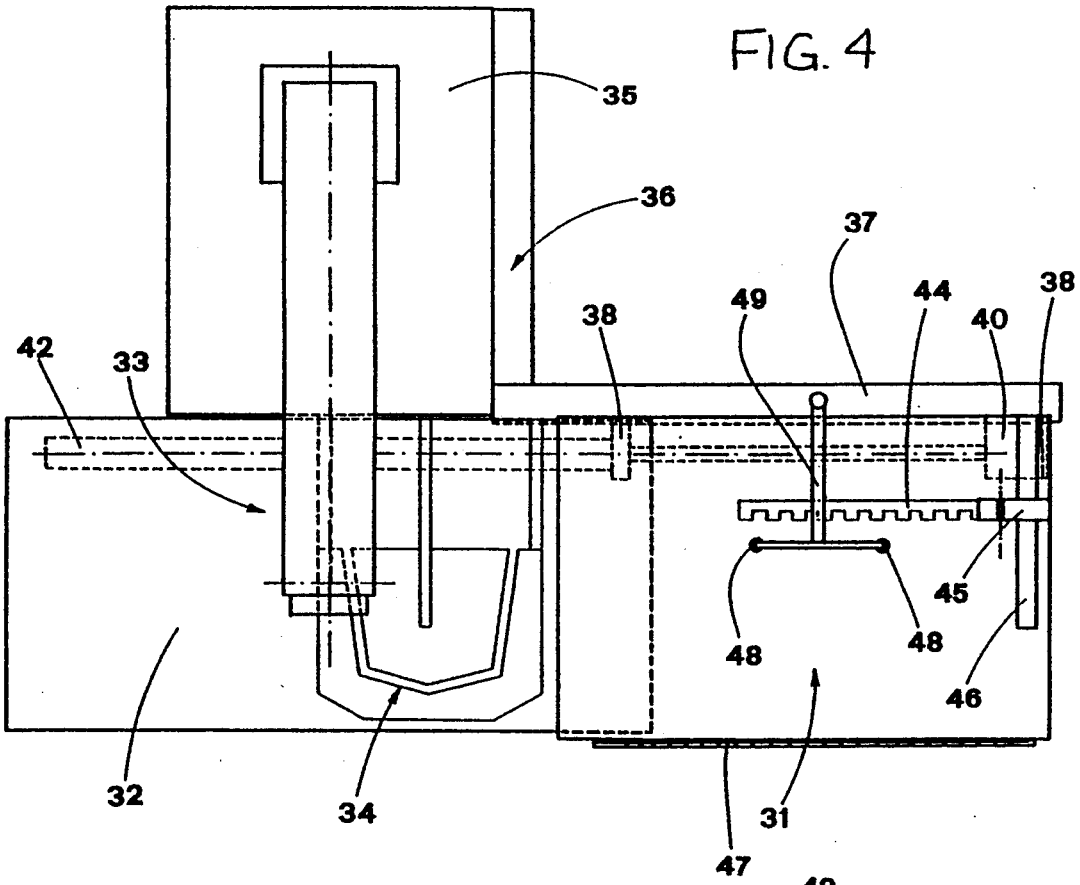
FIG. 4 shows a schematic plan view of a further device which is provided with a movable supporting plane according to the present invention, said device being mounted on an automatic sewing machine and coupled with said jig-guide.
Figure 5:
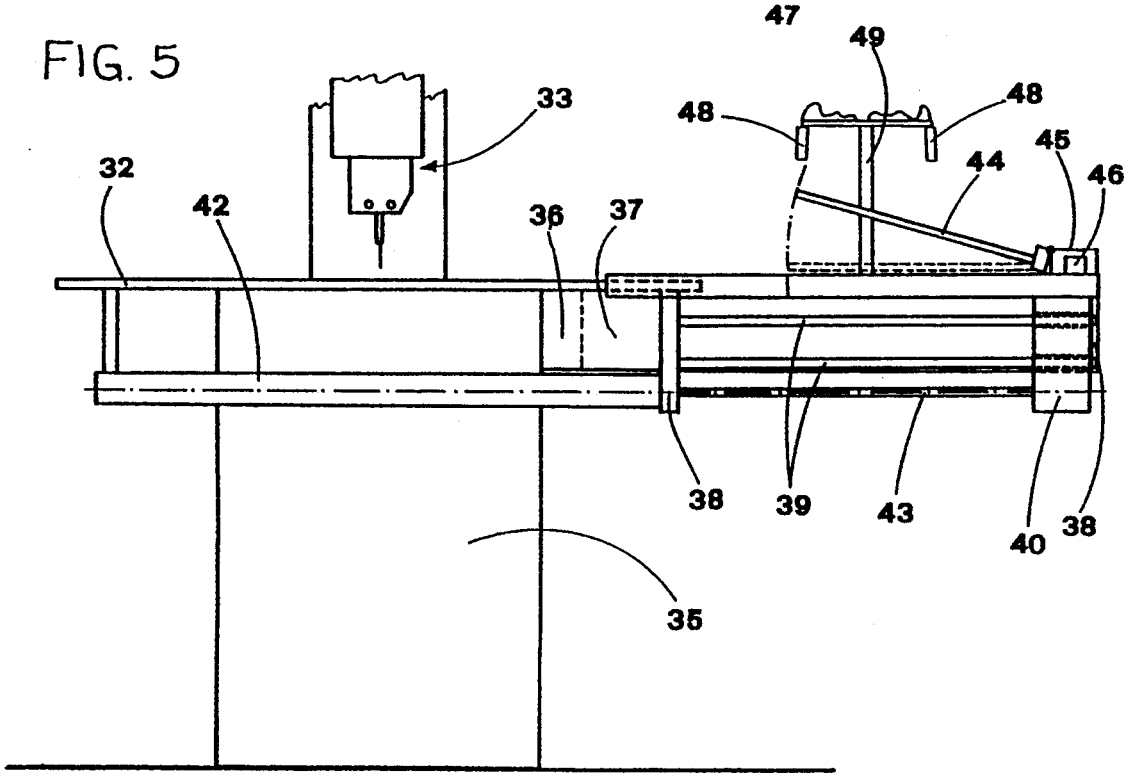
FIG. 5 shows a schematical front view of the device of FIG. 4 showing the sliding means for the movable supporting plane.
Figure 6:
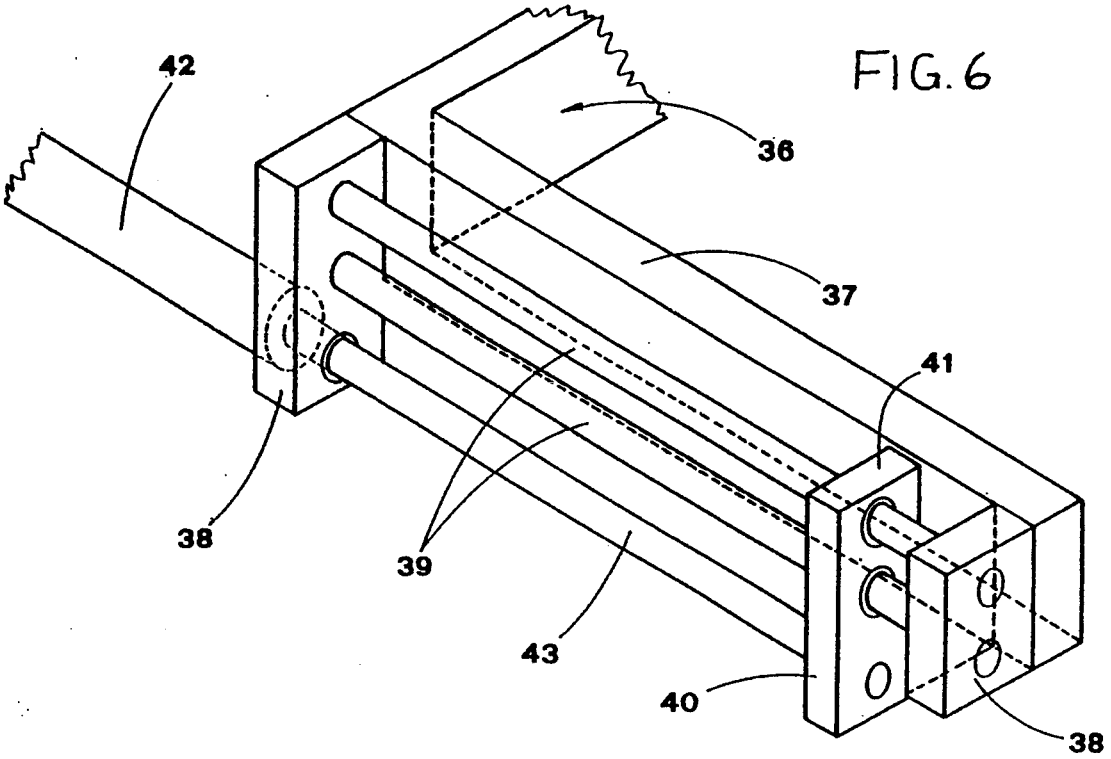
FIG. 6 shows a detail of the means supporting and moving the movable plane.

When the movable supporting plane 31 is positioned outwards and the small arm 44 is lifted, as shown in FIGS. 4 and 5, it is possible to insert the edge of the material in the plane itself. Then, the material is introduced in the jig-guide 34.

In this phase, the material is in part detained by the air suction in the channel 47 and is positioned on the fixed references of the plane itself. Otherwise, the material is positioned in relation to the optic references of the aim projectors 48. Then, the material is fixed with the small arm 44 which is lowered on the material itself.

Figure 7:
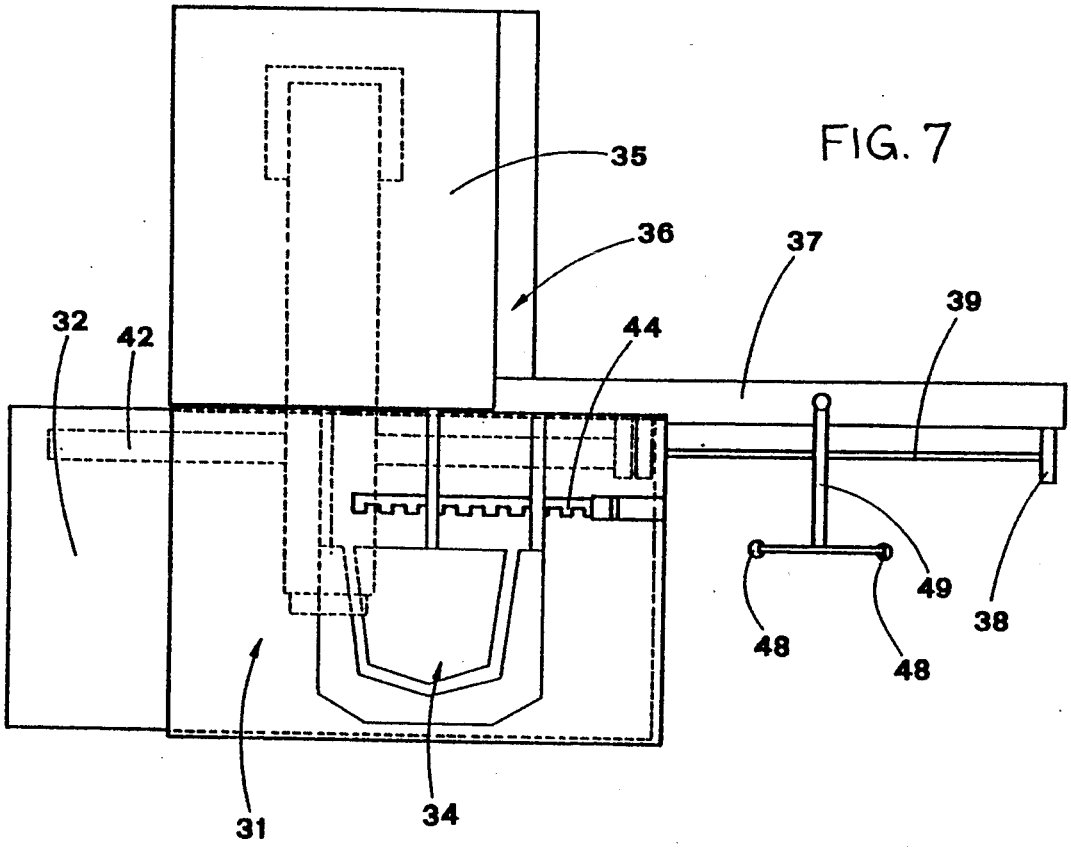
FIG. 7 shows a schematic view of the sliding plane after being displaced towards the jig-guide for clamping and sewing the cloth.

When the sewing machine is free and ready to receive the prepositioned material and the jig-guide 34 is lifted, it is possible to actuate, automatically or through pedals, the intervention of the piston 42 which causes the displacement of the movable socket 40 and the consequent displacement of the plane 31 toward the sewing machine itself till the plane 31 is placed upon the fixed bed 32, as shown in FIG. 7.

At this stage, the material is positioned exactly under the jig-guide 34. Then, the jig-guide 34 is lowered on the material which is thus pressed and detained by the jig-guide itself. Finally, the small arm 44 is lifted and it is possible to actuate the return of the plane 31 which disengages and returns to the starting position. Now, the plane 31 is ready to receive the next strip of material.

Thus, the sewing machine executes all the programmed operations and then, the machine is re-ready to receive the next piece of material which has been previously positioned on the movable plane 31.

As an advantage, there are calibrating elements for calibrating the position of the movable plane 81 as well as control and safety devices for all the operative phases. Such phases will be controlled by the control device of the sewing machine with which such devices co-operate.

The movement of the movable plane 31, caused by the aforesaid jack 42, may be caused by any other suitable device instead of the piston.

The jig-guide device and the material positioning and translating devices have been described and represented according to preferred solutions but other components may be used which are technically equivalent to the mentioned components and are included in the range of protection of the present invention.

I claim:

1. In a programmable sewing machine having a needle for sewing a seam along a programmed pattern lying in a horizontal plane having a transverse direction and a perpendicular longitudinal direction, the improvement comprising:

at least one transverse rail (2) extending in the transverse direction;

a sliding support plane (3) mounted for movement in the transverse direction and on the transverse rail;

a horizontal socket (5) mounted to the sliding support plane (3) for movement in the longitudinal direction;

a supporting plate (14) detachably fixed to the horizontal socket (5) for supporting a base cloth thereon;

a pair of parallel side arms (11) pivotally connected to the horizontal socket for pivoting about an axis extending substantially parallel to the transverse direction, for raising and lowering the side arms with respect to the supporting plate;

a clamping Jig (13) detachably fixed to the side arms (11) and having a recess therein having a shape larger than the programmed pattern and for engaging a periphery of a piece of cloth to be sewn by the programmable sewing machine to the base cloth on the supporting plate;

first drive means (6, 7) connected to the horizontal socket for moving the horizontal socket in the longitudinal direction, the first drive means allowing movement of the horizontal socket in the transverse direction on the sliding support plane;

second drive means (26, 26) connected between the horizontal socket and the side arms for pivoting the side arms to raise and lower the Jig with respect to the supporting plate;

a pair of brackets (19, 19) connected to the horizontal socket;

a form support (21) pivotally mounted to the brackets for pivoting about an axis extending substantially parallel to the transverse direction, for raising and lowering the form support with respect to the Jig;

a form (17) having a shape corresponding to, and smaller than the shape of the recess in the clamping Jig, the form being mounted for movement in the longitudinal direction to the form support;

third drive means (28, 28) connected to the form support for raising and lowering the form support to raise and lower the form, out of and into the recess of the Jig;

fourth drive means (24) connected between the horizontal socket and the form support for moving the form support in the longitudinal direction;

the shape of the recess in the Jig and the shape of the form being selected so that when the form is in the recess of the jig, a slot (25) is formed between the jig and the form, corresponding to the programmed pattern so that a first seam can be made using the sewing machine along the slot, the form being removable from the recess by pivoting the form out of the recess with the third drive means and retracting the form from the recess with the fourth drive means, to expose a piece of cloth on a base cloth between the Jig and the supporting plate, for making a further seam in the piece of cloth; and loading means connected to the programmable sewing machine for loading a piece of cloth on a base fabric, to be sewn to the base fabric, from a location off-set from the supporting plate (14) in the transverse direction, to a location at the supporting plate for engagement by the jig and form.

2. The improvement of claim 1 wherein first drive means comprises a machine casing (7) having a rod (6) extending therefrom and moveable in the longitudinal direction, a pair of shoulders (10) connected to the horizontal socket (5), a horizontal shaft (9) extending between the horizontal shoulders, a head (8) engaged on the horizontal shaft for permitting sliding of the horizontal shaft in the transverse direction, the rod of the machine casing being connected to the head for causing longitudinal movement of the horizontal socket, the horizontal shaft permitting transverse movement of the horizontal socket.

3. The improvement of claim 2, wherein the second drive means comprises a pair of pistons pivotally mounted to the pair of shoulders, each of the pair of pistons being connected to one of the side arms for pivoting the side arms.

4. The improvement of claim 3, wherein the third drive means comprises a pair of second pistons pivotally connected to the pair of brackets, the pair of second pistons being connected to the form support for pivoting the form support and raising and lowering the form.

5. The improvement of claim 4, wherein the fourth drive means comprises a piston connected between the brackets and the form support for moving the form in the longitudinal direction with respect to the form support, and a pair of rods (20, 20) connected to the brackets for longitudinal sliding movement of the form support with respect to the brackets.

6. The improvement of claim 1, further including fifth drive means connected to the sliding support plane (3)

for moving the sliding support plane in the transverse direction along the transverse rail (2).

7. The improvement of claim 6, wherein the programmable sewing machine includes program means for movement along the programmed pattern, the program means being operatively connected to the first and fifth drive means for moving the jig (13) and plate (14) and form (17) along the programmed pattern with respect to the sewing machine needle to sew a seam.

8. The improvement of claim 7, wherein the loading means comprises a sliding horizontal plane (31) mounted for movement in the transverse direction with respect to the sewing machine, a luminous reference (48) connected to the sliding horizontal plane (31) for a precise positioning of the base cloth and piece of cloth in a pre-position on the sliding horizontal plane, blocking means (44) for blocking the piece of cloth on the base cloth, and a Jack (42) connected to the sliding horizontal plane (31) for moving the sliding horizontal plane into a position adjacent the needle of the sewing machine with the piece of cloth in the recess of the Jig (13).

9. The improvement of claim 8, wherein the luminous reference comprises a plurality of aim projectors (48, 48) mounted for illuminating locations on the sliding horizontal plane (31).

10. The improvement of claim 8, wherein the loading means comprises an L-shaped bracket (36) having a pair of legs, one of the legs being connected to the programmable sewing machine, a pair of fixed sockets (38, 38) connected to the other leg of the L-shaped bracket, a pair of shafts (39) connected between the fixed sockets and extending in the transverse direction, a movable socket (40) mounted for movement along the pair of shafts, the sliding horizontal plane being fixed to the moveable socket for movement of the sliding horizontal plane in the transverse direction.

11. The improvement of claim 10, including a further socket (45) mounted for movement in the longitudinal direction on the sliding horizontal plane (31), a small arm (44) pivotally connected to the further socket for pivotal movement above the sliding horizontal plane and a channel on the sliding horizontal plane for engagement by the further socket for movement of the further socket in the longitudinal direction.

12. The improvement of claim 11, including a fore plane (32) under the supporting plate (14), the sliding horizontal plane (31) having edges extending in the transverse direction which are bent down for engagement over the fore plane, for guiding a relative sliding movement of the sliding horizontal plane in the transverse direction with respect to the fore plane.

* * * * *